US005195211A

United States Patent [19]

Krajenke

[11] Patent Number: 5,195,211

[45] Date of Patent: Mar. 23, 1993

[54] GUIDE CHANNEL PIVOT FOR WINDOW REGULATOR

[75] Inventor: Gary W. Krajenke, Warren, Mich.

[73] Assignee: General Motors Corporation, Detroit, Mich.

[21] Appl. No.: 820,162

[22] Filed: Jan. 13, 1992

[51] Int. Cl.[5] ..... E05D 15/16

[52] U.S. Cl. ..... 16/95 R; 16/87; 16/92; 16/93 R; 16/96; 49/351

[58] Field of Search ..... 49/349, 350, 351, 352; 16/87.4 R, 87.6 R, 87 R, 88, 92, 93, 95 R, 96

[56] References Cited

U.S. PATENT DOCUMENTS

| | | | |
|---|---|---|---|
| 3,604,151 | 9/1971 | Ventre et al. | 49/351 |
| 3,888,047 | 6/1975 | Chikaraishi | 49/351 |
| 4,069,617 | 1/1978 | Koike | 16/93 R |
| 4,633,613 | 1/1987 | Kobayashi et al. | 49/352 |

FOREIGN PATENT DOCUMENTS

| | | | |
|---|---|---|---|
| 683349 | 2/1965 | Italy | 16/87.4 R |

*Primary Examiner*—Lowell A. Larson
*Assistant Examiner*—Donald M. Gurley
*Attorney, Agent, or Firm*—Charles E. Leahy

[57] ABSTRACT

A device for slidably and pivotably connecting a window regulator arm to a door inner panel includes, a molded plastic slide channel mounted in a slot provided in the door inner panel. The slot defined by spaced apart walls of the door inner panel and extends along the path of desired movement of the window regulator arm. The molded plastic slide channel has a base adapted to engage against the door inner panel and a pair of spaced apart channel walls projecting from the base and through the slot in the door inner panel. The channel walls snap fit against the walls of the slot to retain the slide channel on the door inner panel. The spaced apart channel walls cooperate to define a guide slot therebetween. A slide member is carried by the window regulator arm and slidably engages with the guide channel to enable pivoting and sliding of the regulator arm along the door inner panel. The presence of the slide member between channel walls prevent the disengagement of the channel walls from the slot of the door panel. The slide member is preferably a spherical stud which is fixedly attached to the window regulator arm. The guide slot defined by the spaced apart channels walls preferably define an opened sided cylindrical slot of circular cross section which receives the spherical stud so that the stud may swivel within the channel.

2 Claims, 1 Drawing Sheet

GUIDE CHANNEL PIVOT FOR WINDOW REGULATOR

The invention relates to a window regulator and more particularly provides a molded plastic guide channel which snap fits into a slot provided in the door inner panel.

BACKGROUND OF THE INVENTION

It is well known in motor vehicles to provide a window regulator which raises and lowers a window. The window regulator is mounted on a door inner panel and includes a gear sector attached to a pivotably mounted lift arm connected to the window. The lift arm is stabilized by a regulator arm having one end pivoted to the lift arm and the other end connected to the door panel by a pivoting guide arrangement which typically includes a rolled steel C-shaped channel of rectangular cross section which is welded or riveted to the door inner panel. The channel receives a slide member which is fixed to the regulator arm. The slide member is typically comprised of a spherical stud which snap fits into a plastic slide or roller. The slide or roller is captured within the channel. During raising and lowering of the window, the slide member slides along the panel and the engagement of the spherical stud within the slide or roller permits a swiveling movement as may be necessary to accommodate the motion of the regulator arm.

It would be desirable to provide a window regulator pivoting guide arrangement which would require fewer parts and be more economical to manufacture and assemble.

SUMMARY OF THE INVENTION

According to the invention, a device for slidably and pivotably connecting a window regulator arm to a door panel includes, a molded plastic slide channel mounted in a slot provided in the door panel. The slot defined by spaced apart walls of the door panel and extends along the path of desired movement of the window regulator arm. The molded plastic slide channel has a base adapted to engage against the door inner panel and a pair of spaced apart channel walls projecting from the base and through the slot in the door panel. The channel walls snap fit against the walls of the slot to retain the slide channel on the door panel. The spaced apart channel walls cooperate to define a guide slot therebetween. A slide member is carried by the window regulator arm and slidably engages with the guide channel to enable pivoting and sliding of the regulator arm along the door inner panel. The presence of the slide member between channel walls prevent the disengagement of the channel walls from the slot of the door panel. The slide member is preferably a spherical stud which is fixedly attached to the window regulator arm. The guide slot defined by the spaced apart channels walls preferably define an opened sided cylindrical slot of circular cross section which receives the spherical stud so that the stud may swivel within the channel.

BRIEF DESCRIPTION OF THE DRAWINGS

These and other objects, features and advantages of the invention will become apparent upon consideration of the description of the preferred embodiment and the appended drawings in which.

DESCRIPTION OF THE PREFERRED EMBODIMENT

Figure 1:
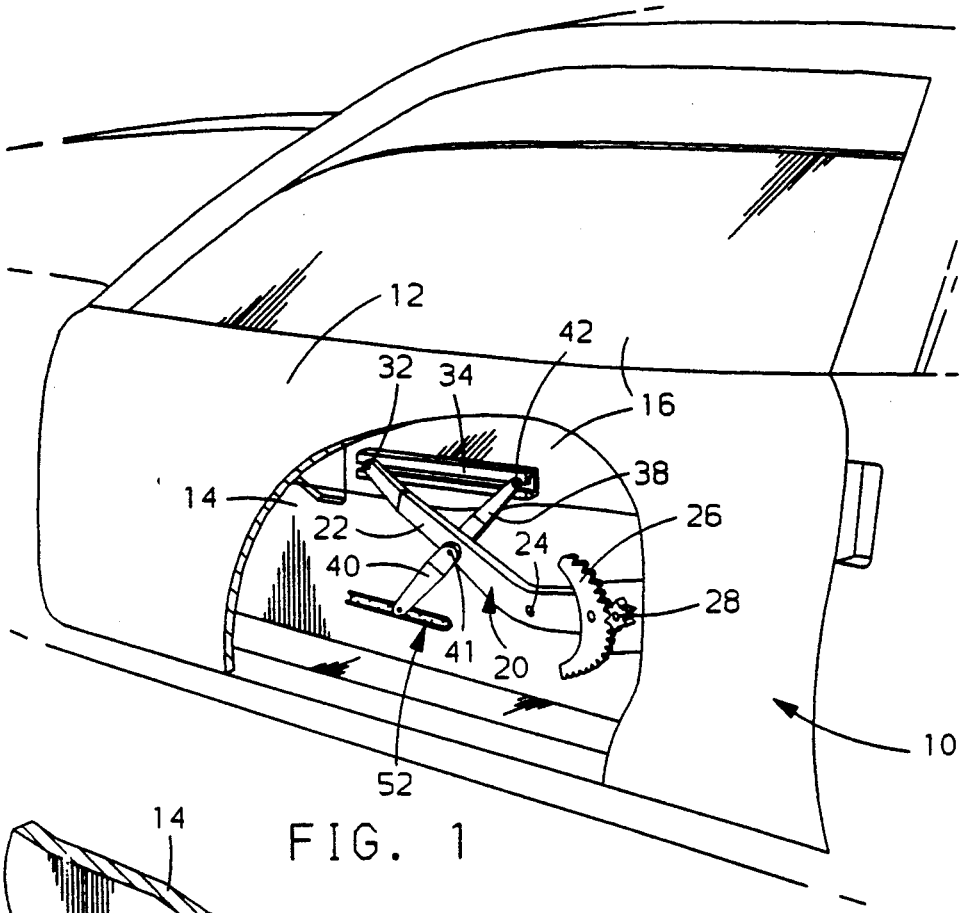
FIG. 1 is a perspective view of a vehicle door having parts broken away to show the window regulator mechanism for raising and lowering the window.

Referring to FIG. 1 it is seen that a vehicle door 10 is defined by an outer panel 12 and an inner panel 14 which define therebetween a window space in which a window panel 16 is raised and lowered by a window regulator mechanism generally indicated at 20.

The window regulator mechanism 20 includes a lift arm 22 which is rotatably mounted on the door inner panel 14 by a pivot 24. The lift arm 22 carries a toothed gear sector 26 which is engaged by a pinion 28 operated by an electric motor or hand crank. The other end of the lift arm 22 carries a roller 32 which is slidably captured in a sash channel 34 attached to the window panel 16. Pivoting of the lift arm 22 about the pivot 24 upon rotation of the pinion gear 28 will raise and lower the lift arm 22 which in turn raises and lowers the window panel 16.

The window regulator is stabilized by a pair of regulator arms 38 and 40. The regulator arm 38 is pivoted to the lift arm 22 by pivot 41 and carries a roller 42 engaged in the sash channel 34.

Figure 2:
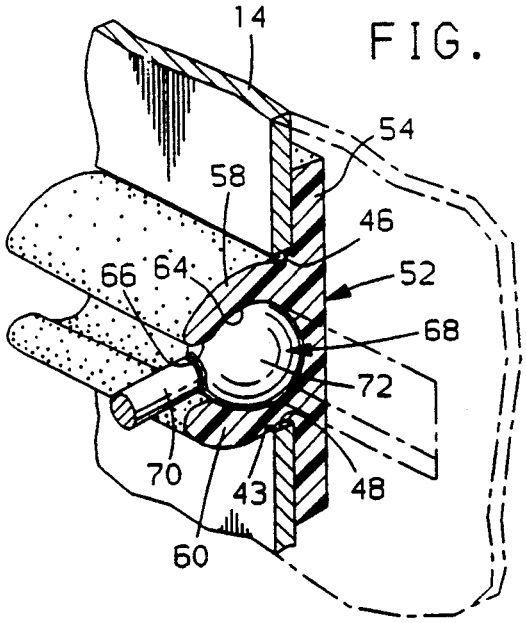
FIG. 2 is an enlarged fragmentary view of the guide channel arrangement having parts broken away and in section.
Figure 3:
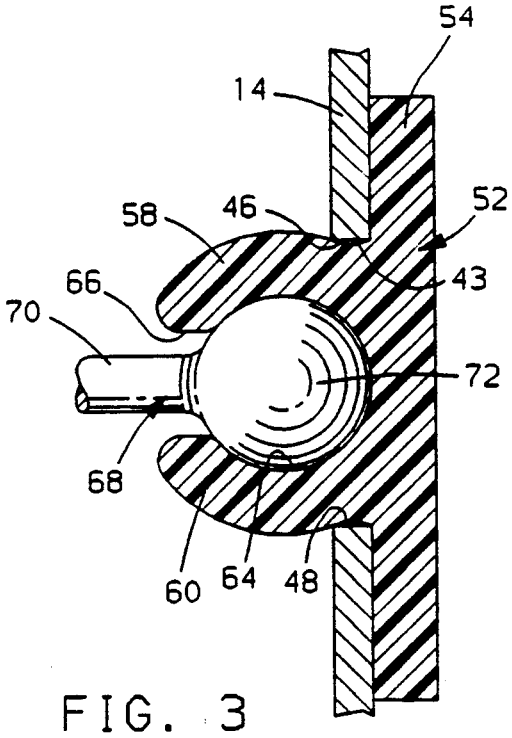
FIG. 3 is an end view of the guide channel arrangement of FIG. 2.

The regulator arm 40 is also connected to the lift arm 22 by the pivot 41 and has a lower end which is slidably and pivotally mounted on the door inner panel as shown in FIGS. 2 and 3.

As seen in FIGS. 2 and 3, the door inner panel 14 has a longitudinal extending slot 43 cut therein and defined by spaced apart walls 46 and 48. The pivoting guide arrangement includes an extruded plastic slide channel 52 which includes a base 54 is adapted to engaged against the door inner panel 14 and has a dimensional extent which is greater than the width of the slot 43 in the door inner panel 14. The slide channel 52 also includes a pair of spaced apart channel walls 58 and 60 which are adapted to project through the slot 43 and engage with the panel walls 46 and 48 defining the slot 43 of the door inner panel 14. The slide member 52 is extruded of a somewhat flexible plastic material which permits the spaced apart walls 58 and 60 to yield inwardly toward one another as the slide member 52 is installed to the door inner panel 14 by pressing the channel walls 58 and 60 through the slot 43.

As seen in FIGS. 2 and 3, channel walls 58 and 60 define therebetween a guide slot 64 of cylindrical shape and circular cross section which is accessible through the open side slot 66 defined between the channels walls 58 and 60.

A spherical stud 68 includes a shank 70 which is fixedly attached to the regulator arm 40 and a spherical ball 72 which is slidably captured within the guide slot 64. As best seen in FIG. 3, the presence of the spherical ball 72 within the slot 64 will prevent the channel walls 58 and 60 from flexing inwardly toward one another and thereby effectively retains the channel 52 on the door inner panel 14.

Referring again to FIG. 1, it will be appreciated that the raising and lowering of the lift arm 22 causes the regulator arm 40 to be shifted so that the spherical stud 68 will slide back and forth along the path defined by the guide slot 64 and the slide channel 52 and that the engagement of the spherical ball 72 within the circular cross-section of the slot 64 will enable the spherical stud 68 to swivel within the slot 64.

Thus it is seen that the invention provides a new and pivoting guide arrangement for a window regulator which accommodates sliding and swiveling movement of the regulator arm with a minimum of parts and expense.

It will be appreciated that the drawing appended hereto show only one embodiment of the invention and that modification can be made by a person of ordinary skill within the cope of the claims appended hereto. For example, the plastic guide channel hereof is not limited to use with the swivel ball stud shown in the preferred embodiment. The plastic slide channel may have a rectangular cross-section to receive a conventional slide or roller mounted on the end of the regulator arm. In addition, the slide channel is not limited to construction of plastic material buy may be of metal or other material.

The embodiments of the invention in which an exclusive property or privilege is claimed are defined as follows:

1. A device for slidably and pivotally connecting a window regulator arm to a door inner panel comprising:

a slot provided in the door inner panel and defined by spaced apart walls of the door inner panel and extending along the path of desired sliding movement of the window regulator arm;

a molded plastic slide channel having a base engaging against the door inner panel and a pair of spaced apart channel walls projecting from the base and through the slot of the door inner panel in snap fitting relationship therewith to retain the slide channel on the door inner panel, said spaced apart channel walls cooperating to define a guide slot therebetween, and a slide member carried by the window regulator arm and slidably engaging the guide slot to enable pivoting and sliding of the regulator arm along the door inner panel.

2. A device for slidably and pivotally connecting a window regulator arm to a door inner panel comprising:

a spherical stud fixedly attached to the window regulator arm and projecting toward the door inner panel;

a slot provided in the door inner panel and defined by spaced apart walls of the door inner panel and extending along the path of desired sliding movement of the window regulator arm; and a molded plastic slide channel having a base engaging against the door inner panel and a pair of spaced apart channel walls projecting from the base and through the slot of the door inner panel in snap fitting relationship therewith to retain the slide channel on the door inner panel, said spaced apart channel walls cooperating to define an open-sided cylindrical slot of circular cross-section receiving the spherical stud in close fitting sliding and pivoting engagement therewith to enable pivoting and sliding of the regulator arm along the door inner panel.

* * * * *